United States Patent [19]

Noyes

[11] 4,402,139

[45] Sep. 6, 1983

[54] METHOD AND APPARATUS FOR DETECTING DOME DEPTH

[75] Inventor: Wesley Noyes, Stillwater, Minn.

[73] Assignee: National Can Corporation, Chicago, Ill.

[21] Appl. No.: 201,716

[22] Filed: Oct. 29, 1980

[51] Int. Cl.[3] ..... B07C 5/06

[52] U.S. Cl. ..... 33/174 L; 33/169 B; 209/598

[58] Field of Search ..... 209/598, 597, 600, 601, 209/911, 530, 531, 532, 533; 33/174 L, 174 R, 168 R, 168 B, 169 R, 169 B, 172 E

[56] References Cited

U.S. PATENT DOCUMENTS

| | | | |
|---|---|---|---|
| 2,578,573 | 12/1951 | Mills | 209/533 |
| 2,852,851 | 9/1958 | Esken | 33/174 L |
| 3,318,137 | 5/1967 | Denlinger et al. | 209/598 X |
| 3,355,811 | 12/1967 | Tailleur | 209/531 X |
| 3,880,749 | 4/1975 | Ramsay | 209/598 X |
| 4,260,483 | 4/1981 | Nicholson et al. | 209/598 X |

*Primary Examiner*—William D. Martin, Jr.

*Attorney, Agent, or Firm*—Robert A. Stenzel; Ralph R. Rath

[57] ABSTRACT

A dome depth detector for a drawn and ironed container having a domed end wall includes a frame that has a first rotatable means supported thereon for guiding the containers along a path, a guide surface on one side of the path on the frame, and a rotatable member on the opposite side of the path which has means engageable with the domed end wall for sensing the depth of the domed end wall and indicating a shallow dome below a preselected minimum. The detector also has a container for counting the number of containers moving along said path.

17 Claims, 3 Drawing Figures

METHOD AND APPARATUS FOR DETECTING DOME DEPTH

TECHNICAL FIELD

The present invention relates generally to container manufacturing and more specifically, to a method and apparatus for measuring the depth of a dome on a drawn and ironed two-piece container.

BACKGROUND PRIOR ART

In the manufacture of drawn and ironed containers, it is standard practice to cut a circular disk from a piece of stock material and form a cup in a cupping machine. The cup is then transferred to a bodymaker wherein the side wall thickness of the cup is reduced and the height is increased. At the end of the stroke of the bodymaker, it is customary to provide an inwardly domed configuration to the end wall of the container to provide increased pressure resistance internally of the container.

Numerous inspections are necessary for assuring that the various components of the drawn and ironed container meet the rigid specifications that have been developed by purchasers of such containers which ultimately use them for packaging products, particularly beer and beverages.

One of the critical parameters of a drawn and ironed container is the depth of the integral dome in relation to the chime of the container. If the dome depth is less than the critical limits, the structural rigidity of the container does not meet minimum requirements. A shallow dome many times cannot be visually observed and can be filled and sealed without detection. Such container will mostly likely "buckle" while being stored in a warehouse where it is subjected to significant temperature changes resulting in internal pressure changes. In other instances, the container might "buckle" when the contents is pasteurized.

Numerous proposals have been made for measuring the various critical dimensional requirements of a drawn and ironed container, but most checking and testing units are rather complicated in nature including electronic equipment and in most instances require that the container be taken out of the processing line in a can manufacturing plant. Such an arrangement adds to the overall cost of the container and reduces the efficiency of the operation.

Of course, it will be appreciated that, when containers are being produced on a mass production at speeds of 200 containers per minute, it is essential that any defect is detected immediately to reduce the number of containers that must be discarded.

SUMMARY OF THE INVENTION

According to the present invention, an extremely simple device has been developed which is capable of insuring that a drawn and ironed container has an inwardly directed dome which has preselected minimum dimension. The unit can be placed in line in a can manufacturing operation and requires no positive drive means or electronic equipment that may be subjected to failure.

More specifically, the dome depth detection device of the present invention is a self-contained unit that has a frame which may be positioned along the path of moving containers and has a container receiver member rotatable thereon. A stop plate is located along one side of the path for the containers and a detecting member is located on the opposite side for detecting the depth of a dome on a drawn and ironed container.

The detector unit is specifically designed for use with containers that are gravity fed along a vertical path and the container receiving means is in the form of a rotating star wheel that has a plurality of circumferentially spaced pockets that are adapted to receive each of the containers in the path. A second member is rotated about an axis perpendicular to the star wheel and has a plurality of circumferentially spaced fingers equal in number to the pockets on the star wheel. A synchronized drive means is interposed between the two rotatable members. The synchronized drive means maintains the pockets and the fingers aligned with each other such that when a container is received into a pocket, the weight of the container will rotate the star wheel which in turn will rotate the second member to rotate the fingers into the centers of the inwardly domed end walls. If the end wall is too shallow, i.e. is less than a preselected minimum, the container is gripped between the finger and the stop surface or plate and the motion is interrupted. Preferably, when this occurs, a detector or sensor senses the jammed container and interrupts the motion of the containers along the path. This may be accomplished by shutting down a component of the can manufacturing facility, such as a trimmer where the containers are trimmed to a predetermined height.

The detector units can also be used as a counter at any location in a can manufacturing facility.

In its preferred form, the detector unit also has indexing means for indexing each of the pockets to be in an exact position for receiving a subsequent container after a container has passed through the detector unit.

In summary, the detector unit is a self-supporting unit which can be assembled into the path of moving containers anywhere in the can manufacturing facility and can reject any containers that have shallow domes and also give an indication to the operator that the bodymaker is making shallow domes.

BRIEF DESCRIPTION OF SEVERAL VIEWS OF DRAWINGS

FIG. 1 of the drawings discloses parts of a trimmer having the detector unit of the present invention associated therewith;

FIG. 2 is a cross-sectional view as viewed along line 2—2 of FIG. 1; and FIG. 3 is a cross-sectional view as viewed along line 3—3.

DETAILED DESCRIPTION

Figure 1:
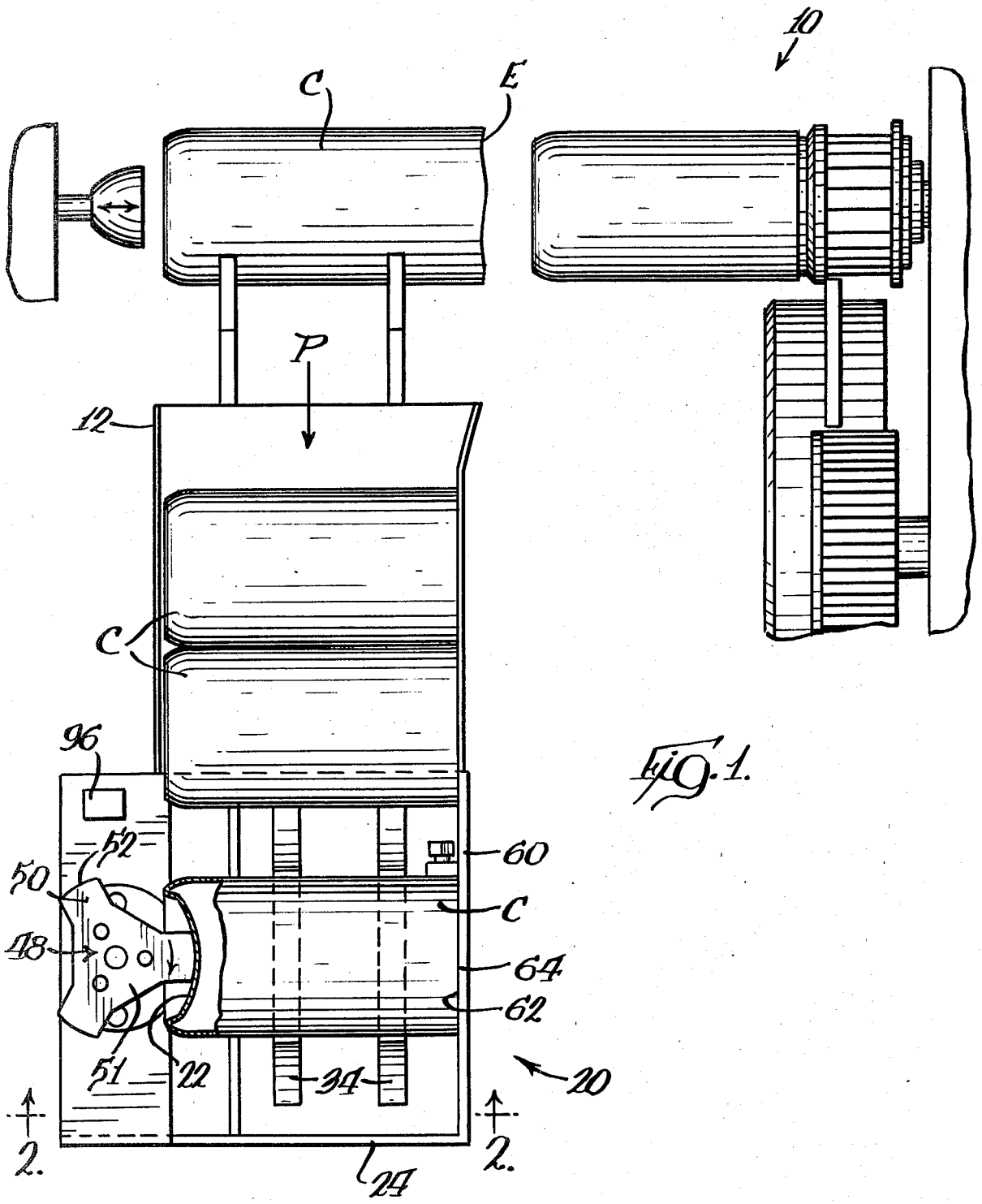

While this invention is susceptible of embodiment in many different forms, there is shown in the drawings and will herein be described in detail a preferred embodiment of the invention with the understanding that the present disclosure to be considered as an exemplification of the principle of the invention and is not intended to limit the invention to the embodiment illustrated.

FIG. 1 of the drawings illustrates a trimming apparatus generally designated by reference numeral 10 for trimming an uneven edge E of a drawn and ironed container C. Trimming apparatus 10 may be of the type disclosed in U.S. Pat. No. RE 28,872, assigned to the assignee of the present invention and incorporated herein by reference.

After the uneven edge of container C has been trimmed by trimmer 10, it is delivered to a chute generally designated by reference numeral 12 to be gravity fed along a path P.

According to the present invention, the containers C are passed through a detector unit generally designated by reference numeral 20. The detector unit is designed to automatically determine whether the domed end wall 22 of container C is below a preselected minimum.

Figure 3:
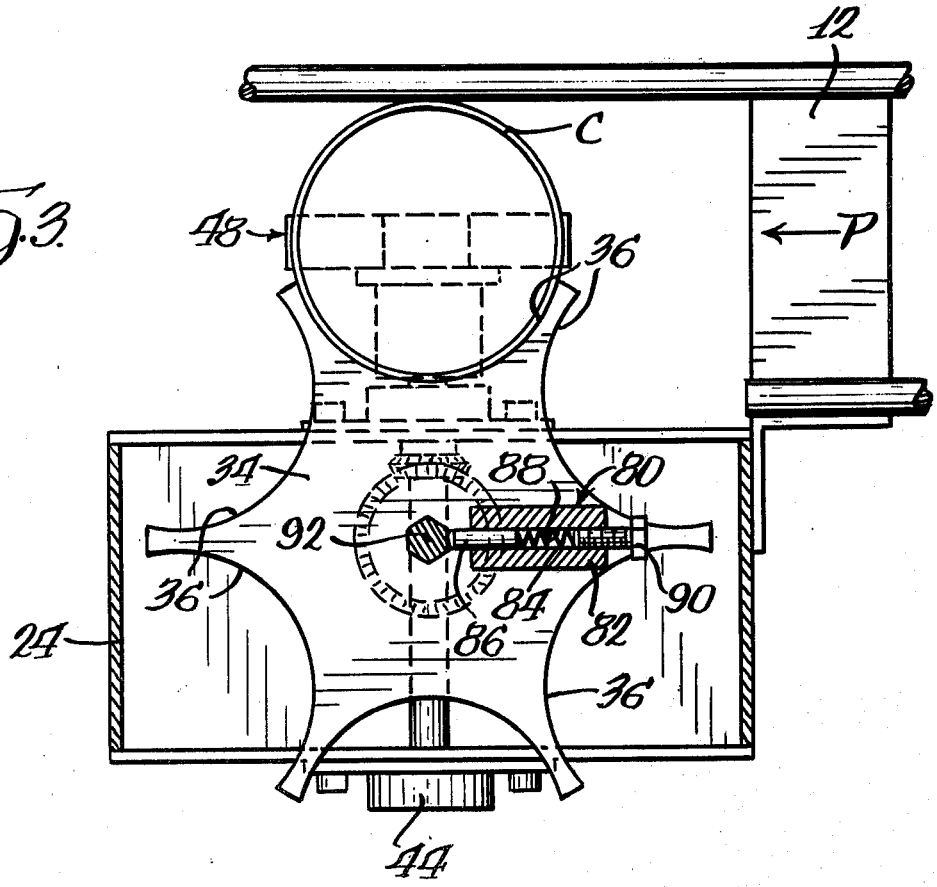

The detector unit of the present invention includes a frame 24 that is located in the path P of the containers C. A first rotatable member or container receiving means 26 is rotatably supported on the frame in the path of container C. The rotatable member 26 includes a shaft 30 that is rotatably supported in a pair of spaced bearings 32 on frame 24 and has a pair of axially spaced star wheels 34 each of which has a plurality of circumferentially spaced pockets 36. The pockets 36 of the respective star wheels are aligned with each other to define container receiving means located in the path P illustrated in FIG. 1. The axis of shaft 30 is offset from the center of path P as illustrated in FIG. 3, for a purpose that will be described later.

A second rotatable member 40 is also supported on frame 24 and includes a shaft 42 which is rotatably supported in bearings 44 secured to frame 24. Shaft 42 extends perpendicular to shaft 30 and is axially aligned therewith with the upper end of the shaft having a sensing means 46 supported thereon. Sensing means 46 is in the form of a wheel 48 having a plurality of circumferentially-spaced fingers 50 extending from the central hub portion 51 thereof with the fingers 50 being equal in number to the pockets 36 on star wheels 34. As illustrated in FIG. 1, the periphery 52 of each finger 50 has a configuration which corresponds substantially to the cross-sectional contour of the domed end wall 22 of container C. Shafts 30 and 42 preferably have keyways so that components can easily be installed using keys C (not shown).

The second rotatable member 46 is located on one side of path P while a fixed guide plate 60 is located on the opposite side of the path P. Guide plate 60 defines a stop means or guide surface 62 adapted to be engaged by the upper free open end 64 of container C.

According to one aspect of the invention, the shafts 30 and 42 have synchronized drive means 66 for maintaining the pockets 36 and the fingers 50 in synchronized driving relation at all times such that the center axial radial points of the respective fingers 50 are axially aligned with the centers of the pockets 36 and thus with the axis of the container when the container is in the position illustrated in FIG. 1. The synchronized drive means 66 is in the form of a first beveled spur gear 70 fixed to the end of shaft 30 and a second beveled spur gear 72 in mesh with gear 70 and fixed to shaft 42.

In the illustrated embodiment of the invention, there are preferably six pockets 36 and three fingers 50, and the synchronized drive means is designed that hub portion 51 makes two revolutions for each revolution of container receiving means 26.

According to a further aspect of the invention, the detecting unit also incorporates an indexing means between the frame and the rotatable star wheels 34, more particularly shaft 30. As illustrated in FIG. 3, indexing means 80 includes a member 82 that is secured to frame 24 and has an opening 84 therein. A plunger 86 is reciprocated within opening 82 and a spring 88 is compressed between plunger 86 and an adjustable screw 90. The free end of the plunger is thus biased into engagement with flat portions 92 formed on the shaft in alignment with plunger 86. The indexing means prevents overtravel of the device so that the next succeeding pocket is properly aligned with the path for receiving a container.

Figure 2:
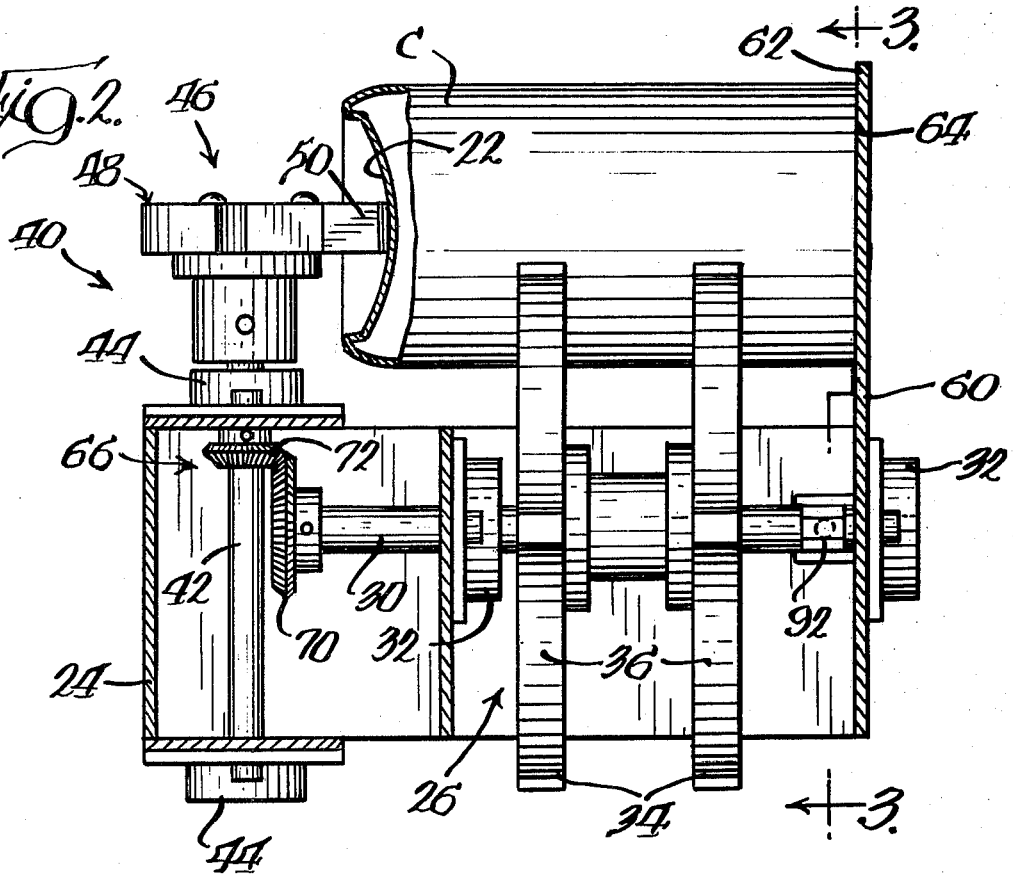

According to a further aspect of the present invention, the detector unit also incorporates sensing means in the form of a sensing element 96 that is supported on frame 24 and is operatively coupled to the drive means for trimmer 10. The sensing means 96 is designed to sense a container in the position illustrated in FIG. 2 and if the container remains in such position for a predetermined time period, such as a time delay incorporated into the sensor 96, the sensor will produce a signal to interrupt the drive means to the trimmer.

According to another aspect of the invention, the detector unit can also easily be used as a counter for counting the number of containers moving along path P. For example, a counter 80 could cooperate with shaft 30 or 42 to give an indication of the number of revolutions which would correspond to a given number of containers. For example, the detector unit could be installed at the exit end of a bodymaker to give an accurate count of the number of containers made and, at the same time, detect any shallow domes.

The operation and method aspects of the present invention are believed to be clear from the above description, but will be briefly summarized at this point. The containers C are received into trimmer 10 with uneven edges E, as illustrated in FIG. 1. The containers C are then moved axially into the trimming apparatus illustrated in FIG. 1 where the uneven edges E are removed. The containers are then fed to the path P in chute 12 towards the detection mechanism 20, which has the axes of shafts 30 and 42 laterally offset from the center of the path P, as shown in FIG. 3. The containers C are received into the respective pockets 36 which are indexed into the proper position by indexing means 80 and the weight of the container will produce rotation of shaft 30. Rotation of shaft 30 will produce synchronized rotation of shaft 42 to cause finger 50 to move toward the dome as the container is moving along the path. The finger ultimately becomes aligned with the center of the container to engage the outer surface of the inwardly domed end wall 22 of container C and force the free end 64 towards guide surface 62. The synchronized drive relation between the pocket and the finger eliminates the possibility of the finger catching on the edge of the dome. If the depth of a dome is below a preselected minimum, the above action will cause the container to jam between the periphery 52 of finger 50 and the adjacent guide surface 62 to prevent the container from exiting the detector mechanism 20. When a container is jammed in the position illustrated in FIG. 1, sensor 96 will sense that the container has remained within the detecting unit and will send a signal to the trimmer to interrupt the operation or motion of the trimmer. The detector and counter unit could also be used at the exit from a bodymaker.

As can be seen from the above description, the present invention provides an extremely simple mechanism for automaticaly detecting shallow domes which requires a minimum number of moving parts and no power source for operating the unit as well as no need for any electric gear to sense the dome depth. With an arrangement of this type, when a bodymaker begins to produce shallow domes, which may not be visibly detectable by an operator, the container manufacturing line is interrupted automatically to minimize the number of defective containers, thereby reducing the loss. Such a feature is of substantial significance when considering the fact that present day manufacturing facilities have a capability of producing as many as 200 containers per minute per bodymaker.

Numerous modifications come to mind without departing from the spirit of the invention. For example, the number of pockets, size being illustrated, may be varied to suit the needs of a particular operation. Also, the novel detecting mechanism could be located at any other location along the container manufacturing path in a container manufacturing operation and need not be associated with the trimmer. The counter could be of another type, such as an electric eye, which could count the number of pockets moved along the circumference of the rotatable member.

I claim:

1. A dome depth detection apparatus for sensing the depth of an inwardly domed end wall of a drawn and ironed container comprising frame means defining a path for gravity feed of said containers, rotatable means on said frame adjacent said path and having pockets for receiving said containers with the weight of said containers causing rotation thereof, a fixed guide surface of said frame means along one side of said path, a rotating member on the opposite side of said path having means engageable with the domed end wall for sensing the depth of the domed end wall of said container and indicating a shallow dome less than a preselected minimum.

2. A dome depth detecting apparatus as defined in claim 1, further including synchronized drive means between said rotating means and said rotating member.

3. A dome depth detection apparatus as defined in claim 2, in which said rotating means and said rotating member are freely rotatable on said frame means.

4. A dome depth detection apparatus as defined in claim 1, further including indexing means between said frame means and said rotating means for indexing said rotating means for receipt of each container.

5. A dome depth detection apparatus as defined in claim 1, further including counter means for sensing the rotation of said rotating means to indicate the number of containers moving along said path.

6. A dome depth detection apparatus for sensing the depth of an inwardly domed end wall on a drawn and ironed container comprising a frame means having a first member rotatable about a fixed axis thereon with said first member having container receiving means thereon supporting said container, a second member rotatable about an axis perpendicular to said fixed axis, means producing synchronized motion between said first and second members to rotate said second member into alignment with said domed end wall on said container in said receiving means, and stop means defining a first position for said container in said container receiving means so that said second member engages said dome when said dome is less than a preselected minimum depth to indicate a shallow dome.

7. A dome depth detection apparatus as defined in claim 6 in which said first member has circumferentially spaced pockets defining said receiving means and said second member has a number of circumferentially spaced fingers each having a free end corresponding substantially to a cross-sectional center portion of said domed end wall.

8. A dome depth detection apparatus as defined in claim 7 in which said stop means is an elongated plate extending parallel to said path on one side thereof.

9. A dome depth detection apparatus as defined in claim 7 in which said first member includes a pair of axially spaced star wheels having axially aligned pockets defining said receiving means and in which said axis of said second member is aligned with the axis of said first member.

10. A method of detecting shallow domes on drawn and ironed containers having a side wall and unitary inwardly-domed end wall comprising the steps of gravity feeding said containers along a path, forming a fixed surface along one side of said path, rotating a wheel about a fixed axis on an opposite side of said path with the wheel having fingers adapted to be received into said domed end wall, and interrupting the motion of said containers along said path when the dome depth is less than a preselected minimum by gripping the container between a finger and said fixed surface.

11. The method defined in claim 10 including the further step of interposing a freely rotatable member into said path aligned with said wheel that is rotated by said container, and rotating said wheel in response to rotation of said member.

12. The method defined in claim 11 including the further step of indexing said rotatable member after each container for receipt of a subsequent container.

13. The method defined in claim 11 in which said rotatable member has pockets for receiving said containers and in which said wheel is driven in synchronized relation with said pockets so that said fingers remain aligned with said pockets.

14. The method defined in claim 14 in which said containers are fed to said path from a trimmer and in which the drive of said trimmer is interrupted when a container is gripped between said surface and a finger.

15. The method defined in claim 10 including the further step of sensing rotation of said wheel and indicating the number of containers moving along said path.

16. A dome depth detection apparatus for sensing the depth of an inwardly-domed end wall of a container comprising frame means defining a path for said containers, rotatable star wheel means having container-receiving pocket means therein freely rotatable on said frame means about a first axis and being located in said path, a guide surface on said frame means along one side of said path, a rotating finger means rotatably mounted on said frame means on the opposite side of said path about a second axis generally perpendicular to said first axis, a synchronized drive means interposed between said first and second axis, said synchronized drive means maintaining said pocket means and said finger means aligned with each other such that rotation of said star wheel means is synchronized with rotation of said finger means whereby said fingers rotate into the center of said container dome end wall to sense the depth of the domed end wall of said container and indicating a shallow dome less than a preselected minimum.

17. A dome depth detection apparatus as defined in claim 16, in which said star wheel has a plurality of circumferentially spaced pockets and said rotating member has an equal number of circumferentially spaced fingers, each of said fingers having a peripheral configuration corresponding substantially to the configuration of a central part of said domed end wall.

* * * * *